US005465963A

United States Patent [19]

Patla, Sr.

[11] Patent Number: 5,465,963

[45] Date of Patent: Nov. 14, 1995

[54] HEIGHT ADJUSTABLE PINBALL GAME CABINET

[75] Inventor: James A. Patla, Sr., Rolling Meadows, Ill.

[73] Assignee: Williams Electronics Games, Inc., Chicago, Ill.

[21] Appl. No.: 243,965

[22] Filed: May 17, 1994

[51] Int. Cl.[6] ..... A63F 7/40

[52] U.S. Cl. ..... 273/118 R; 108/144; 108/158; 273/309

[58] Field of Search ..... 273/309, 118 R, 273/118 A, 123 R, 119 R, 119 A, 398, 400; 473/10, 12, 33; 108/144, 156, 157, 158

[56] References Cited

U.S. PATENT DOCUMENTS 1,083,146 12/1913 Schwartz ..... 108/157 X 5,112,049 5/1992 Bore ..... 273/119 A X

*Primary Examiner*—William H. Grieb

*Attorney, Agent, or Firm*—Rockey, Rifkin and Ryther

[57] ABSTRACT

A game cabinet is supported on legs that are provided with apertures for receiving fasteners such as bolts. The bolts engage mating receptacles formed on the game cabinet. The game cabinet is provided with a greater number of mating receptacles than the legs are provided with holes. Thus, the position of the legs relative to the game cabinet can be changed by aligning the holes with different receptacles thereby to adjust the height of the game.

1 Claim, 1 Drawing Sheet

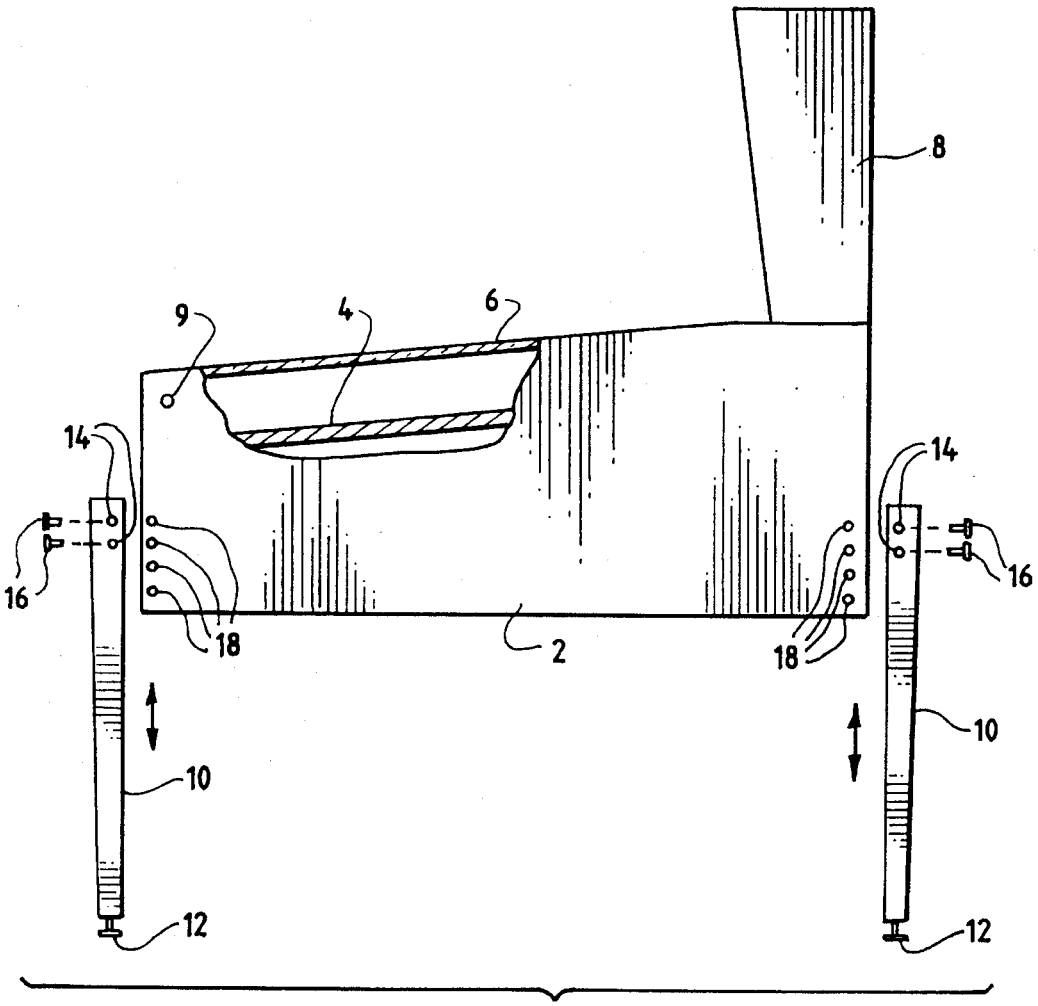
8
9
4
6
14
14
16
16
18
18
2
10
10
12
12

HEIGHT ADJUSTABLE PINBALL GAME CABINET

BACKGROUND OF THE INVENTION

The invention relates, generally, to pinball games and, more particularly, to a height adjustable pinball game cabinet.

Pinball games typically include an inclined playfield supporting a plurality of play features such as bumpers, targets and the like and a rolling ball. The playfield is supported in a cabinet and is covered by a cover glass. The player manipulates flipper buttons mounted on the game cabinet to activate flippers mounted on the playfield thereby to control play of the game. The cabinet, in addition to supporting the playfield, also holds the mechanical workings for the play features, wiring, electronic controls and the like. A back box is supported on the top of the cabinet and typically includes the scoring displays, lights, wiring and/or electronic controls. The cabinet is supported in an elevated position on legs that are bolted to the cabinet. The legs typically include levelers that allow the game operator to adjust the length of the legs slightly to level and stabilize the game.

As will be appreciated, it is desirable that the legs support the game at a height where the flipper buttons can be comfortably reached by the game player. In existing games, however, the legs are mounted to the cabinet such that the height of the cabinet is not adjustable. As a result, the height of the typical game, although suitable for most players, is not suitable for all players.

The inventor has discovered that it is desirable for the game operator to be able to mount the game cabinet at different heights to accommodate all players. For example, it is desirable that games played by children or people in wheel chairs be mounted lower than those played by adults. Moreover, because pinball games are used all over the world, it is desirable to have height adjustable games to accommodate the physical characteristics of different races and nationalities.

Thus, a pinball game having a height adjustable cabinet is desired.

BRIEF DESCRIPTION OF THE INVENTION

The invention consists of a game cabinet supporting the playfield and back box in a manner similar to that on existing pinball games. The game legs are provided with apertures for receiving fasteners such as bolts. The bolts engage mating members formed on the game cabinet. The game cabinet, however, is provided with a greater number of mating members than the legs are provided with holes. Thus, the position of the legs relative to the game cabinet can be changed by aligning the holes with different mating members thereby to adjust the height of the game.

BRIEF DESCRIPTION OF THE DRAWINGS

The FIG. is a side view of a pinball game with the height adjustable legs of the invention.

DETAILED DESCRIPTION OF THE INVENTION

Referring more particularly to the Figure, the pinball game of the invention includes a game cabinet 2 that supports an inclined playfield 4. Mounted to playfield 4 are a plurality of play features such as targets, flippers, bumpers, ramps and the like (not shown). A cover glass 6 is mounted over the playfield to protect the game. Mounted to the top of the cabinet 2 is a back box 8 and located on both sides of the game are player operated flipper buttons 9 (only one of which is shown in the Figure).

Four legs 10 support the game (although only two legs are visible in the Figure) and are fixed to the corners of cabinet 2. Each leg can be provided with a leveler 12 that screwthreadably engages the bottom of the leg to provide a slight adjustment for leveling and stabilizing the game.

A pair of through holes 14 are provided near the top of each leg and are dimensioned to receive fasteners 16. Provided at each of the four corners of the cabinet 2 are a plurality of mating receptacles 18 for receiving fasteners 16. In the preferred embodiment fasteners 16 comprise threaded bolts and receptacles 18 comprise mating threaded holes for receiving the bolts. The receptacles 18 are vertically spaced from one another the same distance as the distance between the through holes 14. As a result, the through holes 14 can be aligned with any two adjacent receptacles such that length of leg extending below the cabinet 2 and, therefore, the height of the game can be adjusted. Conversely, it is also possible to have only two receptacles on the cabinet and a greater number of through holes formed on the legs such that the receptacles on the cabinet could be aligned with any two through holes on the legs.

The means for fastening the legs to the cabinet could also consist of a plurality of threaded members extending from the game cabinet which pass through through holes 14 and are secured by nuts. Moreover, the fasteners could consist of threaded members extending from legs 10 and engaging through holes formed on the cabinet 2 to be secured by nuts. Finally, fasteners other than threadably engageable members could also be used if desired.

Thus, the fastening arrangement between legs 12 and cabinet 2 provide the game operator a simple and easy way to adjust the height of the game to accommodate differences in the height of players. While the invention was described in some detail with respect to the drawings, it will be appreciated that numerous changes in the details and construction of the device can be made without departing from the spirit and scope of the invention.

What is claimed is:

1. A height adjustable pinball game, comprising:

a) a cabinet for supporting the game;

b) a plurality of legs for supporting the cabinet in an elevated position; and c) means for securing the legs to the cabinet at different locations on the cabinet to permit the cabinet to be supported in a plurality of elevated positions, said securing means including:

i) two through holes on each of said legs and at least three vertically arranged threaded receptacles corresponding thereto on said cabinet, said threaded receptacles being spaced from one another the same distance as the distance between said through holes such that the through holes can be aligned with different pairs of said threaded receptacles, and ii) a plurality of threaded fasteners for engaging the through holes and the aligned threaded receptacles to securely attach the legs to the cabinet whereby the length of the leg extending beyond the cabinet and, therefore, the height of the cabinet can be adjusted.

* * * * *